US012404681B2

(12) United States Patent
Brulinski

(10) Patent No.: US 12,404,681 B2
(45) Date of Patent: Sep. 2, 2025

(54) BUILDING SLABS PAD

(71) Applicant: Vinderen Sp. z o. o., Warsaw (PL)

(72) Inventor: Mariusz Maciej Brulinski, Warsaw (PL)

(73) Assignee: VINDEREN SP. Z O. O., Warsaw (PL)

( * ) Notice: Subject to any disclaimer, the term of this patent is extended or adjusted under 35 U.S.C. 154(b) by 205 days.

(21) Appl. No.: 18/377,895

(22) Filed: Oct. 9, 2023

(65) Prior Publication Data

US 2024/0295127 A1 Sep. 5, 2024

(30) Foreign Application Priority Data

Mar. 1, 2023 (PL) ..... W.131278

(51) Int. Cl.
*E04F 15/02* (2006.01)
*E04C 2/40* (2006.01)

(52) U.S. Cl.
CPC .. *E04F 15/02022* (2013.01); *E04F 15/02183* (2013.01); *E04F 15/02* (2013.01); *E04F 15/02038* (2013.01); *E04F 2201/01* (2013.01); *E04F 2201/03* (2013.01); *E04F 2201/035* (2013.01)

(58) Field of Classification Search
None
See application file for complete search history.

(56) References Cited

U.S. PATENT DOCUMENTS 4,287,693 A * 9/1981 Collette ..... B32B 3/06 52/302.1
5,014,488 A * 5/1991 Evangelos ..... E04F 13/144 52/390
5,815,995 A * 10/1998 Adam ..... E04F 15/02194 52/177
6,467,224 B1 * 10/2002 Bertolini ..... E04F 15/043 52/177
D481,470 S * 10/2003 Moller, Jr. ..... D25/163
6,802,159 B1 * 10/2004 Kotler ..... E04F 15/02194 52/592.1

(Continued)

FOREIGN PATENT DOCUMENTS

AU 2006233243 A1 * 5/2007 ..... E04F 15/10
CA 2394715 A1 * 7/2002

(Continued)

*Primary Examiner* — Phi D A
*Assistant Examiner* — Phi D Tran
(74) *Attorney, Agent, or Firm* — Myers Wolin, LLC

(57) ABSTRACT

A building slab pad in the form of a square plate is divided into four analogous sections, each section being formed by four linear projections on the top surface that run from the center of each edge and converge in the center of the pad. On each of the two side edges of the sections there is a trapezoidal protrusion respectively with a base narrower than the rest of the protrusion and a keyway respectively corresponding in shape to the protrusions, with two protrusions and two keyways alternating on each side edge of the pad. On the top surface there are linear top indentations running from the corners of the pad and converging in the center of the pad. On the underside are four linear bottom indentations running from the center of each edge to the center of the adjacent edge to form a square shape.

5 Claims, 11 Drawing Sheets

(56) References Cited

U.S. PATENT DOCUMENTS

| | | | | |
|---|---|---|---|---|
| 7,757,449 | B2 * | 7/2010 | Portoles | E04F 15/041 52/592.1 |
| 10,697,130 | B2 * | 6/2020 | Jones | E01C 11/222 |
| 11,274,454 | B2 * | 3/2022 | Moller, Jr. | E04F 15/02188 |
| 2003/0061772 | A1 * | 4/2003 | Bertolini | E04F 15/022 52/177 |
| 2011/0023389 | A1 * | 2/2011 | Myers | E04F 15/105 52/173.1 |
| 2021/0230882 | A1 * | 7/2021 | Moller, Jr. | E04F 15/02161 |
| 2023/0417068 | A1 * | 12/2023 | Smith | E04F 15/02188 |

FOREIGN PATENT DOCUMENTS

| | | | | |
|---|---|---|---|---|
| CA | 3029289 | A1 * | 7/2019 | E01C 5/20 |
| EP | 2894276 | A1 * | 7/2015 | E04F 15/18 |
| PL | 440398 | A1 | 8/2023 | |

* cited by examiner

BUILDING SLABS PAD

CROSS-REFERENCE TO RELATED APPLICATIONS

This application claims priority under 35 U.S.C. § 119 from PL Application W.131278 filed Mar. 1, 2023, the contents of which are incorporated by reference herein.

FIELD

The subject of the present disclosure is a pad for building panels such as stoneware, clinker, clay, concrete slabs, reinforced concrete slabs, stone slabs, rubber slabs or plastic slabs.

BACKGROUND

Terrace boards need to be laid on special pads. The pads are laid on a level, stable surface with drainage for the space under the panels.

There are a number of decking panels pads. The most common are circular pads which have upward projections that divide the pad into four sections to place the slabs in the corners. The protrusions occur only on part of pads radii. The pads are placed only on the corners of the laid boards which gives a small contact area between the pad and the board.

There are also pads in the shape of four connected polygons with several point-like protrusions dividing the pad into four sections.

There are also pads with a series of through holes to ensure drainage for the space under the panels.

The pads are made of rubber or plastic.

Existing solutions either do not provide full contact between the board and the pad and, above all, in any type of pad, it may be necessary to make joints between the boards after they are laid. Grout deteriorates over time and becomes unsightly stained and discolored. In addition, the pads do not have connections between them which is not conducive to stabilizing the position of the panels and does not prevent them from sliding apart.

SUMMARY

The subject of the present disclosure is a building slab pad that eliminates all the disadvantages of pads known from the state of the art.

The building slab pad according to the present disclosure is in the form of a square board and is divided into four analogous sections. Each section is formed by four linear protrusions on the top surface of the pad that run from the center of each edge and converge in the center of the pad.

Each of the two side edges of the section has a protrusion with a base narrower than the rest of the protrusion and a groove corresponding in shape to the protrusion, with two protrusions and two grooves alternating on each side edge of the pad.

In addition, on the top surface of the pad there are linear top indentations running from the corners of the pad and converging in the center of the pad. The pad in each section has at least one hole.

On the underside of the pad are four linear bottom indentations running from the center of each edge to the center of the adjacent edge to form a square shape.

The pad is made of rubber material bonded with polymer adhesive.

Advantageously, the projections and protrusions are in the shape of an inverted trapezoid with rounded corners.

Another benefit is that the bottom surface of the pad has four linear indentations running from the center of each edge and converging in the center of the pad.

Polyurethane glue, epoxy glue, acrylic glue or neoprene glue are advantageously used as glue.

Advantageously, there is one central circular hole in each section.

The pad can be made with different dimensions to suit the size of the panels to be laid.

The pad can be made in different thicknesses to suit the amount of water drained and the weight of the panels.

The pads are laid on a level, stable surface with drainage for the space under the panels. Then a system of inlets and outlets connects them to each other. A stable connection is obtained to prevent the plates from sliding apart. The edge and corner pads are easily cut by removing unnecessary sections. A series of linear holes on the top and bottom surfaces of the pad and central circular holes facilitate water drainage. After connecting the pads and laying the boards on them, the spaces between the boards are filled with linear protrusions of the top surface of the pads, and the resulting final surface, such as a terrace, does not require grouting.

DETAILED DESCRIPTION OF THE PREFERRED EMBODIMENTS

Figure 1:
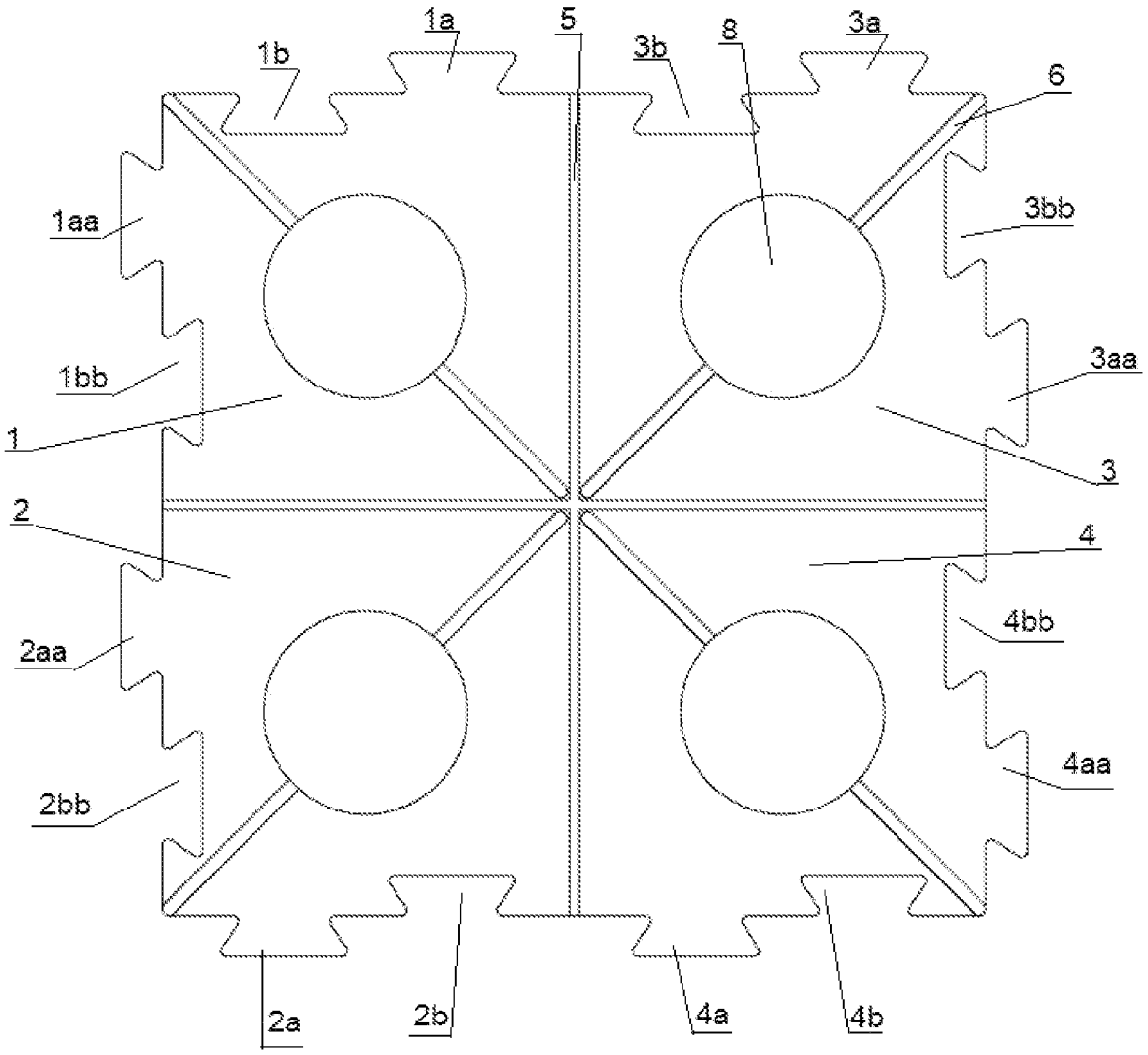
FIG. 1 shows a top view of the pad with protrusions and trapezoidal grooves of the present disclosure.
Figure 2:
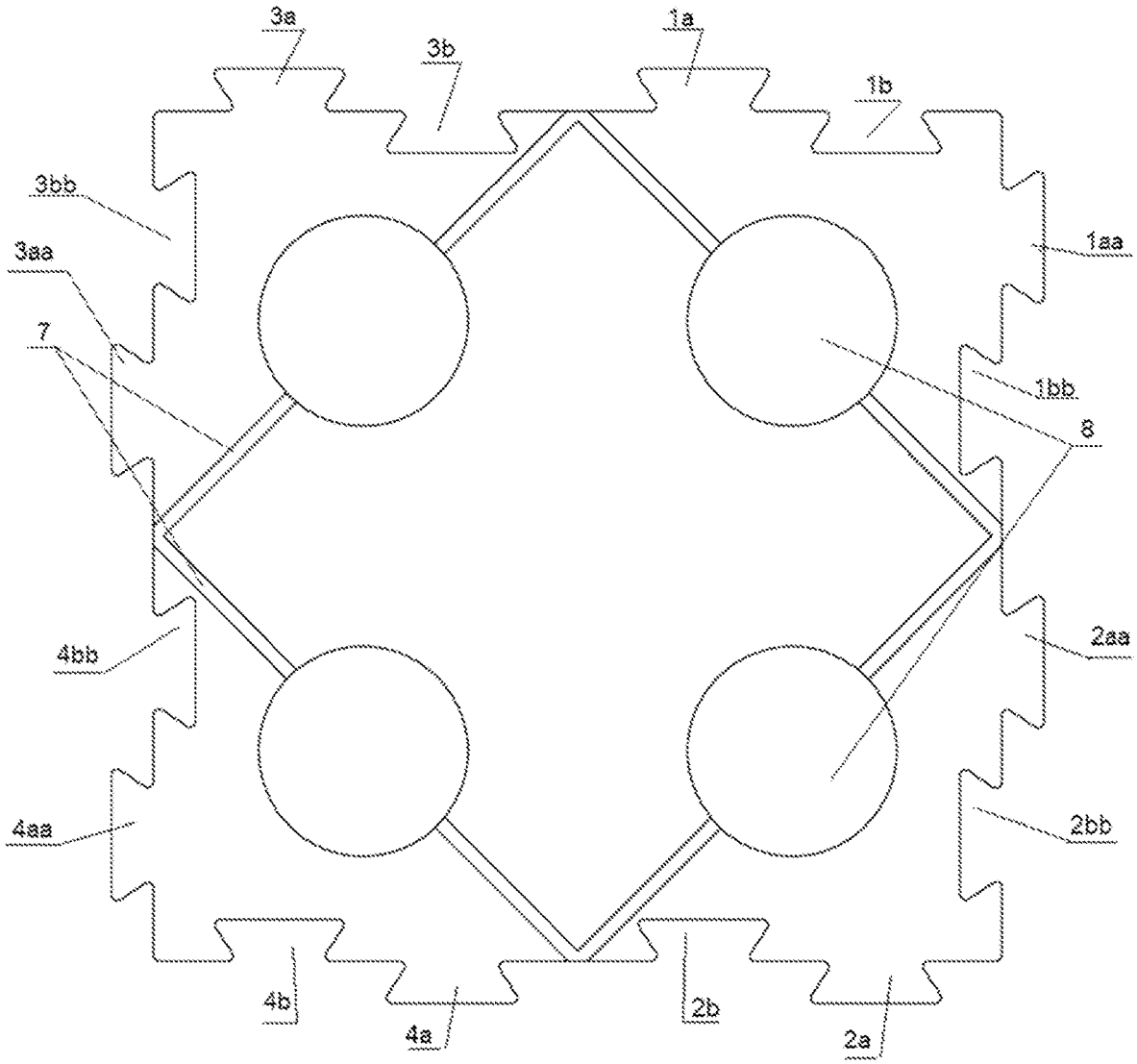
FIG. 2 shows a bottom view of the pad with protrusions and trapezoidal grooves.
Figure 3:
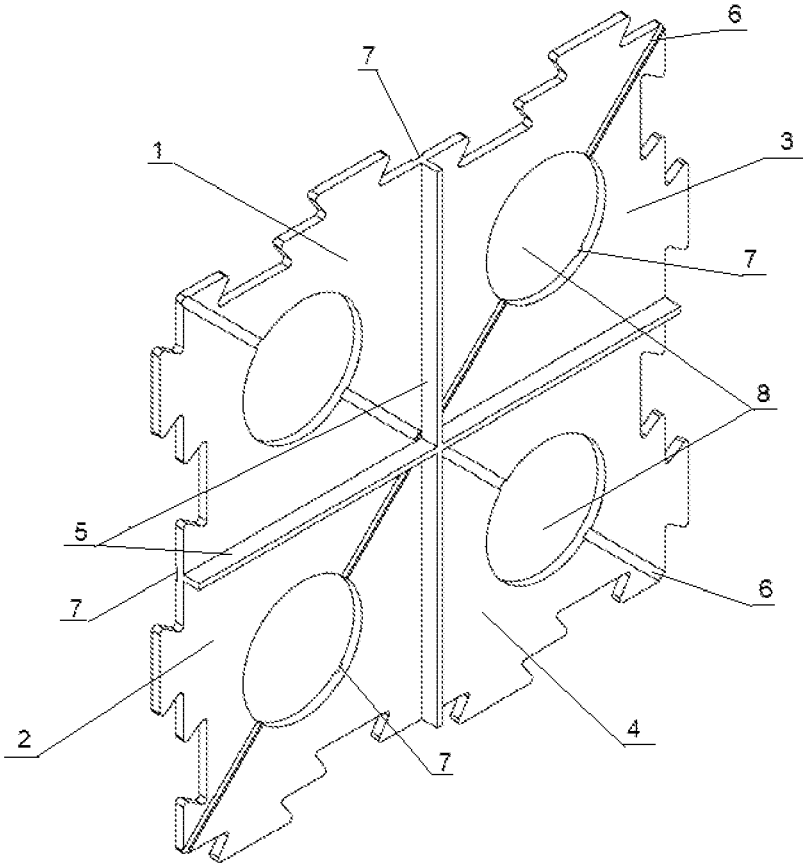
FIG. 3 shows an axonometric view of the pad with protrusions and trapezoidal grooves from above.
Figure 4:
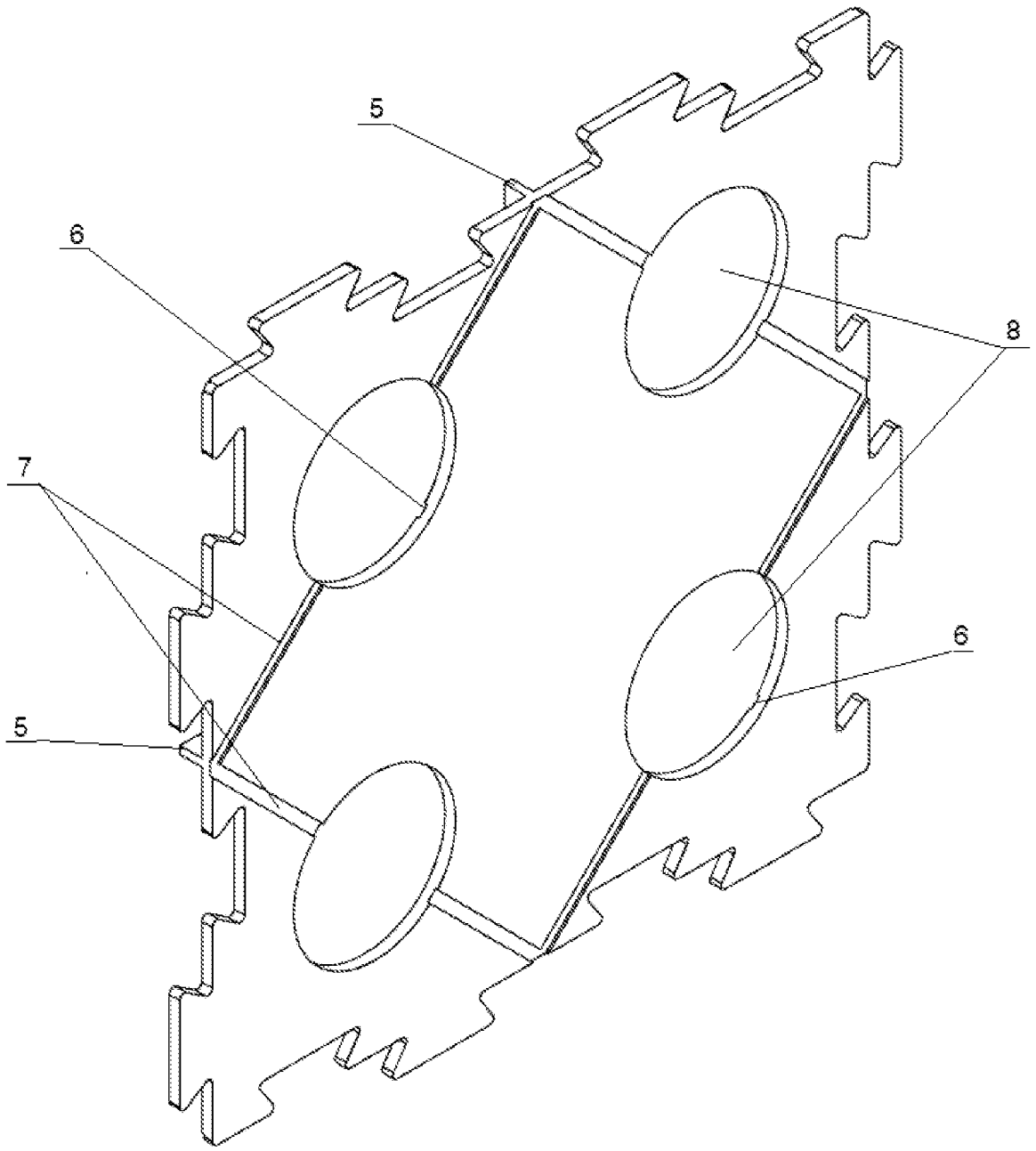
FIG. 4 shows an axonometric view of the pad with protrusions and trapezoidal grooves from below.
Figure 5:
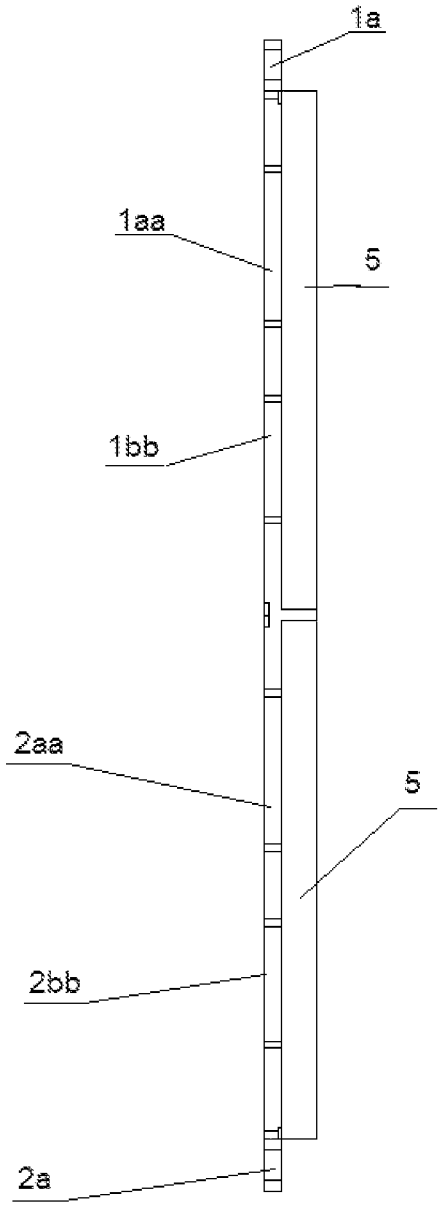
FIG. 5 shows an axonometric view of the pad from the side.
Figure 6:
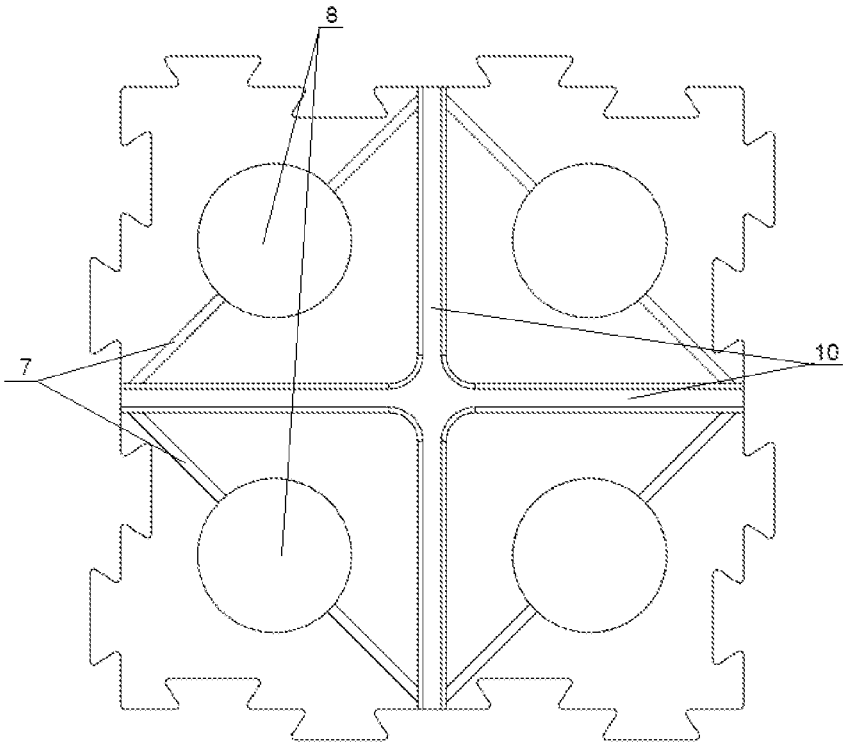
FIG. 6 shows a bottom view of the pad with projections and trapezoidal grooves with additional recesses on the lower surface.
Figure 7:
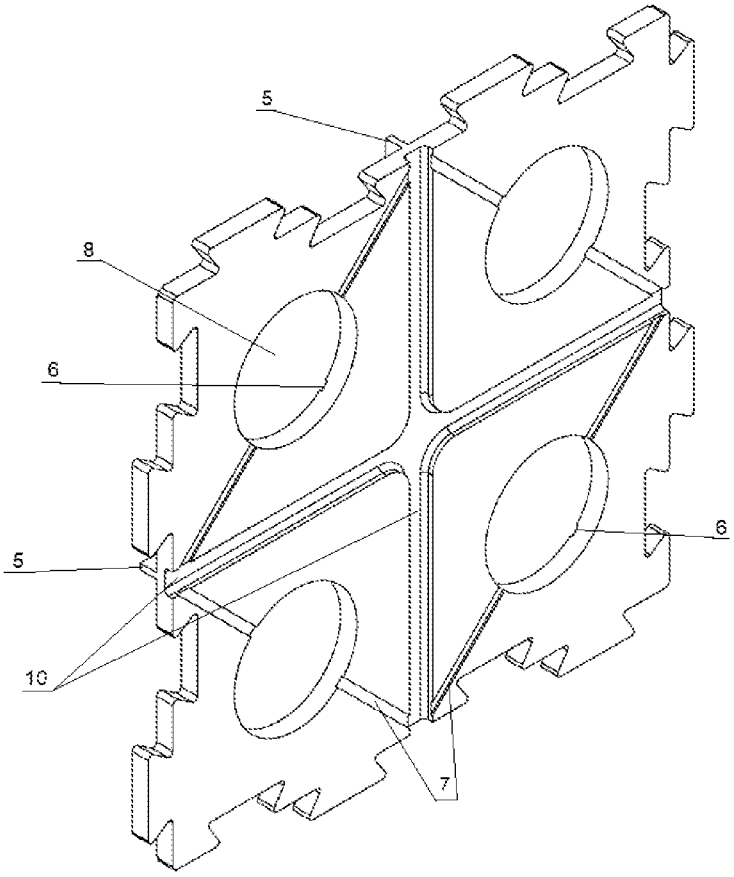
FIG. 7 shows an axonometric view from FIG. 6 from above.
Figure 8:
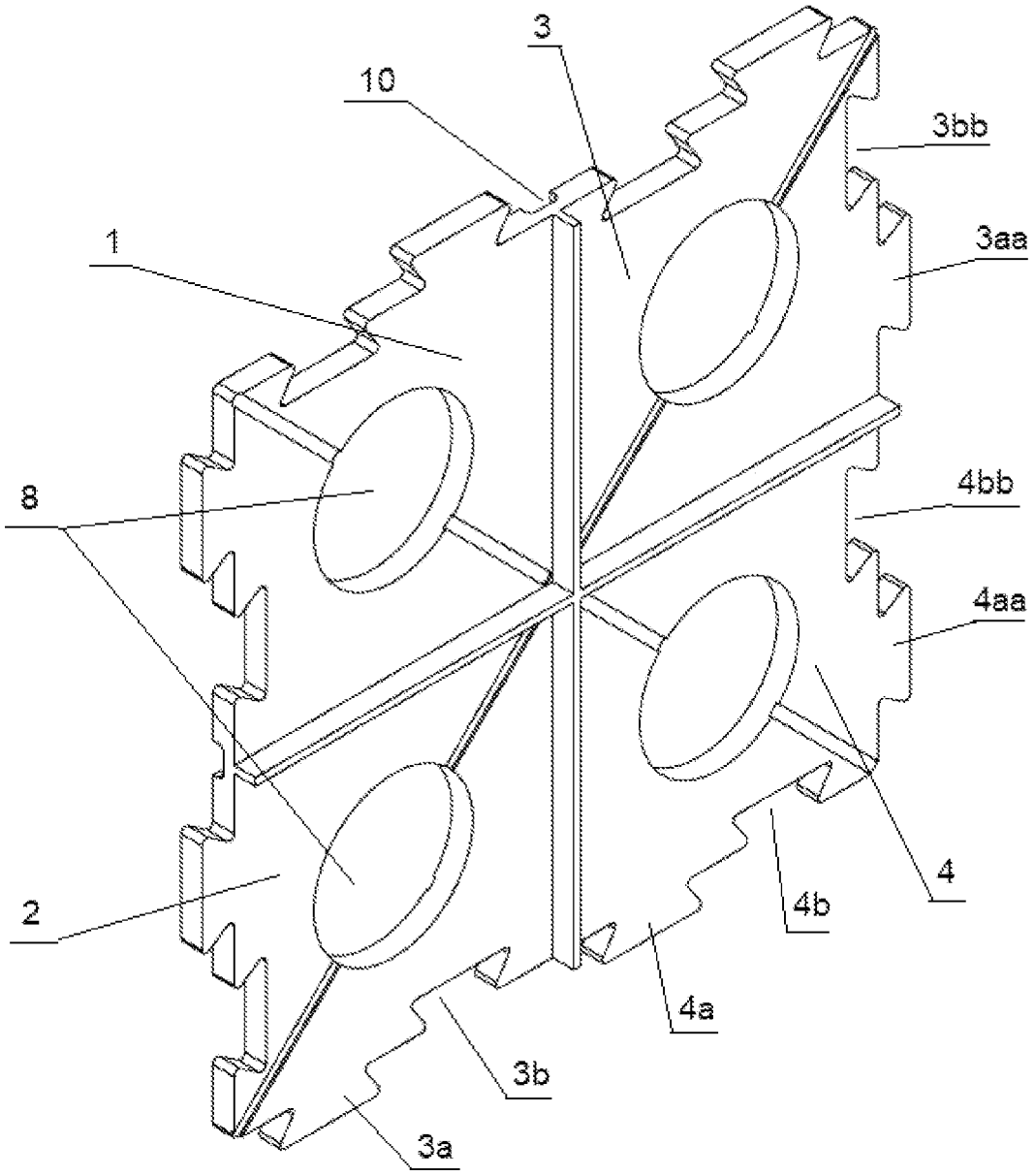
FIG. 8 shows an axonometric view from FIG. 6 from the bottom.
Figure 9:
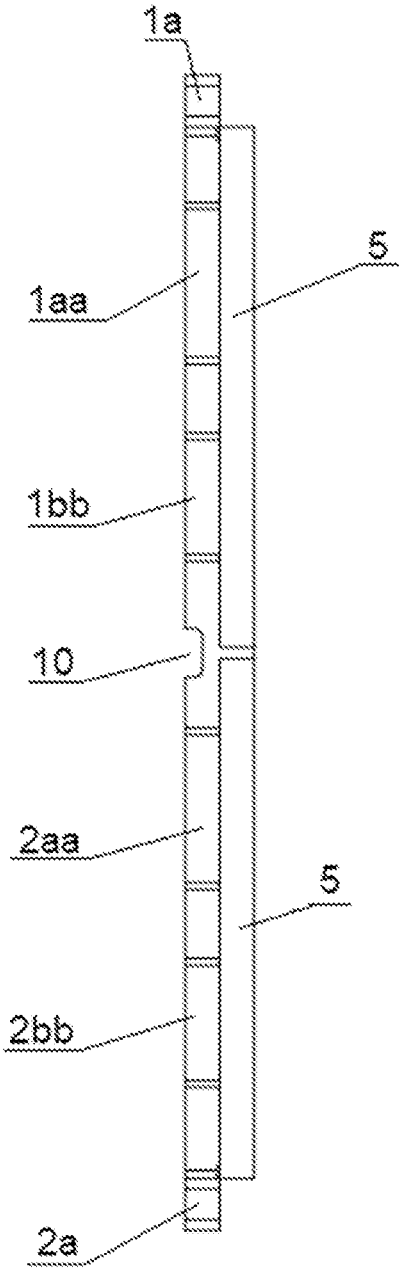
FIG. 9 shows an axonometric view from FIG. 6 from the side
Figure 10:
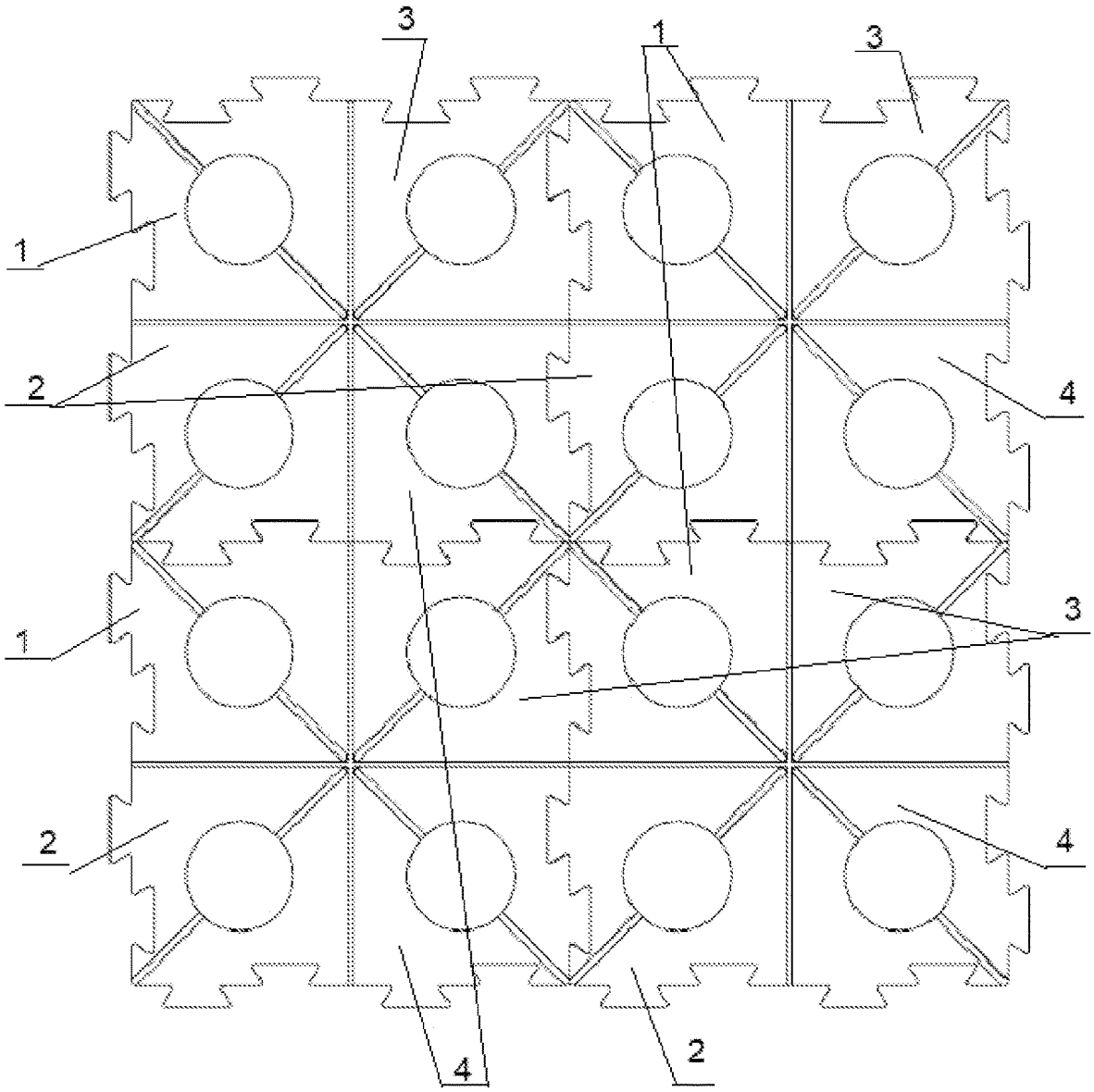
FIG. 10 shows a top view of the combined four pads.
Figure 11:
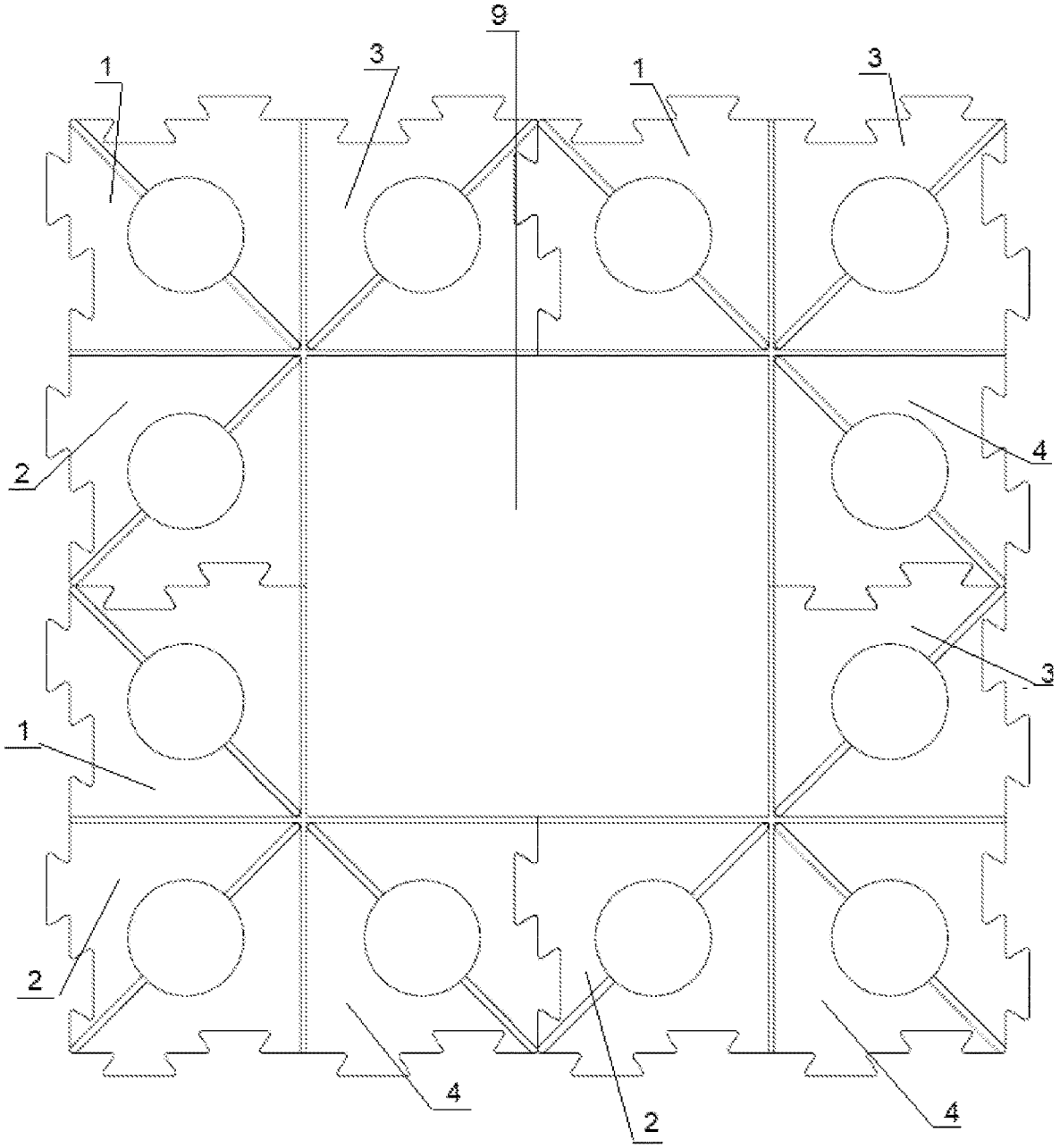
FIG. 11 shows a top view of the connected four pads with a board on them.

As shown in the figures, the pad is in the form of a square plate and is divided into four analogous sections 1, 2, 3 and 4. Each section is formed by four linear protrusions on the top surface of the pad that run from the center of each edge and converge in the center of the pad.

On each of the two side edges of sections 1, 2, 3 and 4 there is a trapezoidal protrusion 1*a*, 1*aa*, 2*a*, 2*aa*, 3*a*, 3*aa*, 4*a* and 4*aa* respectively with a base narrower than the rest of the protrusion and a keyway 1*b*, 1*bb*, 2*b*, 2*bb*, 3*b*, 3*bb*, 4*b* and 4*bb* respectively corresponding in shape to the protrusions, with two protrusions and two keyways alternating on each side edge of the pad.

In addition, on the top surface of the pad there are linear top indentations running from the corners of the pad and converging in the center of the pad.

On the underside of the pad are four linear bottom indentations running from the center of each edge to the center of the adjacent edge to form a square shape.

The pad in each section 1, 2, 3 and 4 has a central circular hole 8. The pad is made of rubber material bonded with polymer adhesive. Polyurethane glue is used as an adhesive, while epoxy glue, acrylic glue or neoprene glue can also be used. The pad can be made with different dimensions to suit the size of the panels to be laid. The pad can be made in different thicknesses to suit the amount of water drained and the weight of the panels.

The pads are laid on a level, stable surface with drainage for the space under the panels. Then a system of inlets and outlets connects them to each other. A stable connection is obtained to prevent the plates from sliding apart 9. The edge and corner pads are easily cut by removing unnecessary sections. Linear upper recesses 6 and lower recesses 7 and central circular holes 8 facilitate water drainage. After connecting the pads and laying the boards 9 on them, the spaces between the boards 9 are filled with linear protrusions of the top surface of the pads, and the resulting final surface, such as a terrace, does not require grouting. Boards 9 are laid with their entire surface on pads which improves their stability.

The pad on the bottom surface may have four linear indentations 10 running from the center of each edge and converging in the center of the pad. Recesses 10 are used to accommodate electrical cables intended for outdoor use.

What is claimed is:

1. A building board pad comprising drainage holes and four sections formed by protrusions on an upper surface in the form of a square board and divided into four analogous sections (1), (2), (3) and (4), each section being formed by protrusions on the upper surface of the pad, four linear protrusions (5) running from the center of each edge and converging in the center of the pad, and further comprising on each of the two lateral edges of sections (1), (2), (3) and (4) a trapezoidal projection (1*a*), (1*aa*), (2*a*), (2*aa*), (3*a*), (3*aa*), (4*a*) and (4*aa*) respectively with a base narrower than the rest of the projection and a keyway (1*b*), (1*bb*), (2*b*), (2*bb*), (3*b*), (3*bb*), (4*b*) and (4*bb*) respectively corresponding in shape to the projections, with the two projections and two keyways alternately arranged on each side edge of the pad, and further comprising on the top surface of the pad linear top indentations (6) running from the corners of the pad and converging in the center of the pad, and further comprising on the underside of the pad four linear bottom indentations (7) running from the center of each edge to the center of the adjacent edge forming a square shape, and further comprising at least one hole (8) in each section, the pad being made of rubber material bonded with polymer adhesive.

2. The pad according to claim 1, wherein the projections (1*a*), (1*aa*), (2*a*), (2*a, a*), (3*a*), (3*aa*), (4*a*), (4*aa*) and the protrusions (1*b*), (1*bb*), (2*b*), (2*bb*), (3*b*), (3*bb*), (4*b*)(4*bb*) have a shape of an inverted trapezoid with rounded corners.

3. The pad according to claim 1, wherein the lower surface of the pad further comprises four linear indentations (10) running from the center of each edge and converging in the center of the pad.

4. The pad according to claim 1, further comprising a polyurethane adhesive, epoxy adhesive, acrylic adhesive or neoprene adhesive.

5. The pad according to claim 1, further comprising one central circular hole (8) in each section (1), (2), (3) and (4).

* * * * *